US010435877B2

(12) United States Patent
Fukuya et al.

(10) Patent No.: US 10,435,877 B2
(45) **Date of Patent: *Oct. 8, 2019**

(54) FLUSH TOILET AND BUBBLE GENERATION UNIT

(71) Applicant: LIXIL Corporation, Tokyo (JP)

(72) Inventors: Kouji Fukuya, Tokyo (JP); Hirokazu Shimasaki, Tokyo (JP); Masato Wakabayashi, Tokyo (JP); Shuhei Haida, Tokyo (JP); Koji Shimizu, Tokyo (JP)

(73) Assignee: LIXIL Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/756,560

(22) PCT Filed: Aug. 3, 2016

(86) PCT No.: PCT/JP2016/072854

§ 371 (c)(1),
(2) Date: Feb. 28, 2018

(87) PCT Pub. No.: WO2017/038362

PCT Pub. Date: Mar. 9, 2017

(65) Prior Publication Data

US 2018/0266092 A1 Sep. 20, 2018

(30) Foreign Application Priority Data

Aug. 31, 2015 (JP) ..... 2015-171385

(51) Int. Cl.

| | |
|---|---|
| ***E03D 11/08*** | (2006.01) |
| ***E03D 5/10*** | (2006.01) |
| ***E03D 9/02*** | (2006.01) |
| ***E03D 11/02*** | (2006.01) |

(52) U.S. Cl.
CPC ..... *E03D 11/08* (2013.01); *E03D 5/10* (2013.01); *E03D 9/02* (2013.01); *E03D 11/02* (2013.01)

(58) Field of Classification Search
CPC ..... E03C 11/08
USPC ..... 4/223
See application file for complete search history.

(56) References Cited

U.S. PATENT DOCUMENTS

2018/0291607 A1 10/2018 Shimasaki et al.

FOREIGN PATENT DOCUMENTS

| | | |
|---|---|---|
| CN | 102677758 | 9/2012 |
| JP | 6-85476 | 12/1994 |
| JP | 8-302796 | 11/1996 |
| JP | 9-4025 | 1/1997 |
| JP | 2003-27557 | 1/2003 |
| JP | 2004-100331 | 4/2004 |

(Continued)

OTHER PUBLICATIONS

International Search Report dated Oct. 18, 2016, directed to International Application No. PCT/JP2016/072854; 2 pages.

(Continued)

*Primary Examiner* — Lori L Baker
(74) *Attorney, Agent, or Firm* — Morrison & Foerster LLP

(57) ABSTRACT

A flush toilet includes a toilet bowl part, flush water conduits that guides flush water toward the toilet bowl part, a bubble passage provided separately from the flush water conduits, the bubble passage that guides bubbles toward the toilet bowl part, and a bubble generator provided in the bubble passage, the bubble generator that generates bubbles.

4 Claims, 8 Drawing Sheets

(56) References Cited

FOREIGN PATENT DOCUMENTS

| | | |
|---|---|---|
| JP | 2008-138420 | 6/2008 |
| JP | 2008-138422 | 6/2008 |
| JP | 2008-240442 | 10/2008 |
| JP | 2009-256917 | 11/2009 |
| JP | 2013-234526 | 11/2013 |
| KR | 10-2011-0008973 | 1/2011 |
| KR | 10-2013-0077763 | 7/2013 |

OTHER PUBLICATIONS

International Preliminary Report on Patentability dated Mar. 6, 2018, directed to International Application No. PCT/JP2016/072854; 11 pages.
Decision to Grant Patent dated Jan. 8, 2019, directed to Japanese Application No. 2015-171384; 6 pages.
Extended European Search Report dated Mar. 29, 2019, directed to European Patent Application No. 16841393.8; 6 pages.
International Preliminary Report on Patentability dated Mar. 6, 2018, directed to International Application No. PCT/JP2016/072853; 11 pages.
International Search Report dated Oct. 18, 2016, directed to International Application No. PCT/JP2016/072853; 2 pages.
Shimasaki et al., U.S. Office Action dated Feb. 7, 2019, directed to U.S. Appl. No. 15/756,558; 9 pages.
Partial European Search Report dated Apr. 1, 2019, directed to European Patent Application No. 16841394.6; 10 pages.
Notification of Reason(s) for Refusal dated Jan. 8, 2019, directed to Japanese Application No. 2015-171385; 5 pages.

FLUSH TOILET AND BUBBLE GENERATION UNIT

REFERENCE TO RELATED APPLICATIONS

This application is a national stage application under 35 USC 371 of International Application No. PCT/JP2016/072854, filed Aug. 3, 2016, which claims the priority of Japanese Application No. 2015-171385, filed Aug. 31, 2015, the entire contents of each of which are incorporated herein by reference.

FIELD OF THE INVENTION

The present invention relates to flush toilets, and more particularly to a flush toilet capable of supplying bubbles into a toilet bowl part.

BACKGROUND OF THE INVENTION

Conventionally known are flush toilets that supplies flush water mixed with bubbles to a toilet bowl part. By spreading bubbles on a water surface of the toilet bowl part, for example it is possible to suppress scattering of a liquid at the time of urination by a male person or to wash the toilet bowl part.

As a method of supplying flush water mixed with bubbles to a toilet bowl part, a method of providing, in a flow passage of flush water through which flush water flows, a device called ejector that narrows the diameter of a part of the passage is proposed (for example, Patent Document 1). The air and a cleaner are externally supplied to the ejector. When flush water for washing the interior of the toilet bowl part flows into the ejector, an ejector effect is generated in which the interior of the ejector is negatively pressured. The air is drawn into the ejector by this ejector effect, and the flush water, the air and the cleaner are mixed to generate bubbles which flow into the toilet bowl part as bubble-mixed flush water.

[patent document 1] JP 2008-138422 A

SUMMARY OF THE INVENTION

However, in the conventional method of supplying bubbles as described above, since the ejector is provided in the passage through which the flush water flows, there is a possibility that the amount of flush water is limited by the small diameter part of the ejector. On the other hand, in a case where the small diameter part of the ejector is enlarged in order to secure an adequate amount of flush water, there is a possibility that sufficient bubbles cannot be generated.

The present invention has been made in view of such problems, and it is an object of the present invention to provide a flush toilet and a bubble generation unit capable of suitably supplying bubbles into a toilet bowl part while an adequate amount of flush water is maintained.

In order to solve the above problems, a flush toilet according to an aspect of the present invention includes: a toilet bowl part; a flush water conduit that guides flush water toward the toilet bowl part; a bubble passage provided separately from the flush water conduit, the bubble passage that guides bubbles toward the toilet bowl part; and a bubble generator provided in the bubble passage, the bubble generator that generates bubbles.

According to this aspect, since the bubble passage is provided separately from the flush water conduit, and the bubble generator is provided in the bubble passage, it is possible to maintain an adequate amount of flush water without needing to reduce the diameter of a part of the flush water conduit as in the conventional art. In addition, since the bubble passage and the bubble generator can be optimally designed to generate bubbles, bubbles can be suitably supplied into the toilet bowl part.

Another aspect of the present invention is a bubble generation unit. This bubble generation unit is attached to a flush toilet and includes: a bubble passage that guides bubbles toward a toilet bowl part of the flush toilet; and a bubble generator provided in the bubble passage, the bubble generator that generates bubbles.

Also according to this aspect, since the bubble passage is provided separately from the flush water conduit of the flush toilet, a similar effect to that of the flush toilet described above can be obtained. Furthermore, according to this aspect, it is possible to provide a bubble generating function to existing flush toilets.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which.

DETAILED DESCRIPTION OF THE INVENTION

Figure 1:
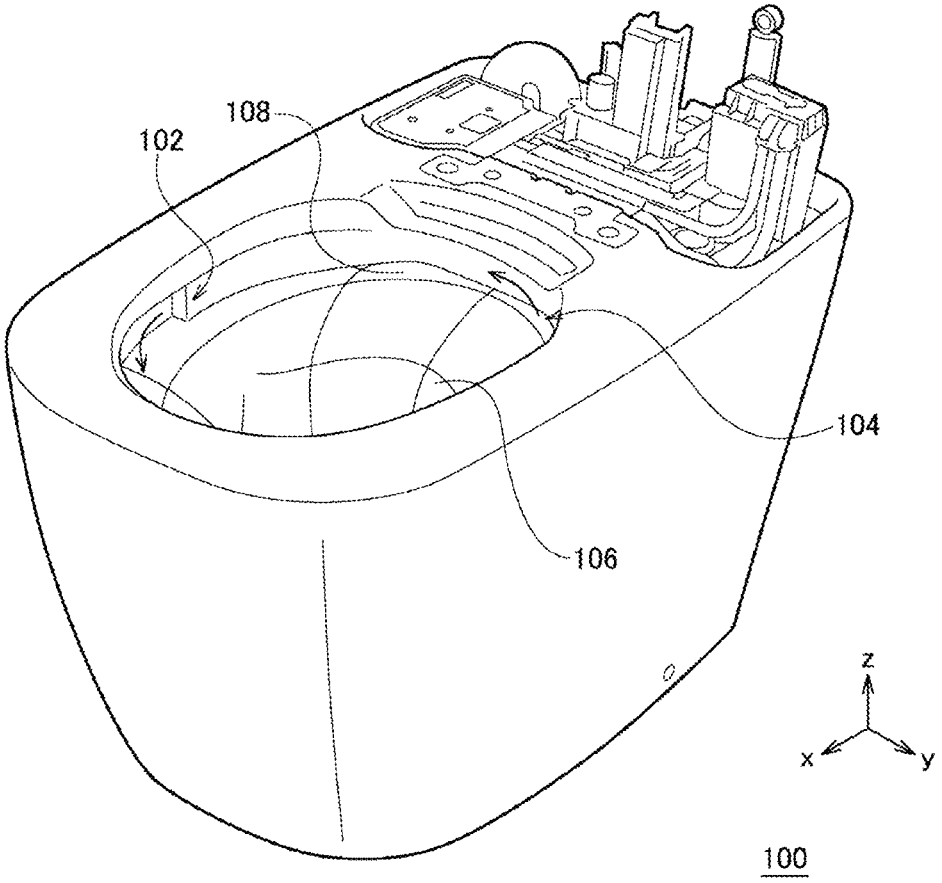
FIG. 1 is a front perspective view of a flush toilet according to an embodiment of the present invention.

A flush toilet according to an embodiment of the present invention will be described in detail below with reference to the drawings. The same or equivalent components, members, and processing illustrated in the drawings are denoted by the same reference numerals, and redundant descriptions will be omitted as appropriate. Moreover, embodiments do not limit the invention but examples. All the characteristics or combinations thereof described in the embodiments are not necessarily essential to the invention.

FIG. 1 is a front perspective view of a flush toilet 100. The flush toilet 100 illustrated in FIG. 1 has a flush water tank and a flush water pump built therein. The flush water pump discharges flush water stored in the flush water tank from a first water discharge port 102 and a second water discharge port 104 to a toilet bowl part 106. The flush water discharged from the second water discharge port 104 flows on a water guide shelf 108 (rail) formed on an inner wall surface of the toilet bowl part 106 and merges with the flush water discharged from the first water discharge port 102 to swirl inside the toilet bowl part 106 to fall. Note that a functional units (not illustrated) for providing a private part washing function, a warm air function, or other functions may be mounted on a rear end portion of the flush toilet 100.

Figure 2:
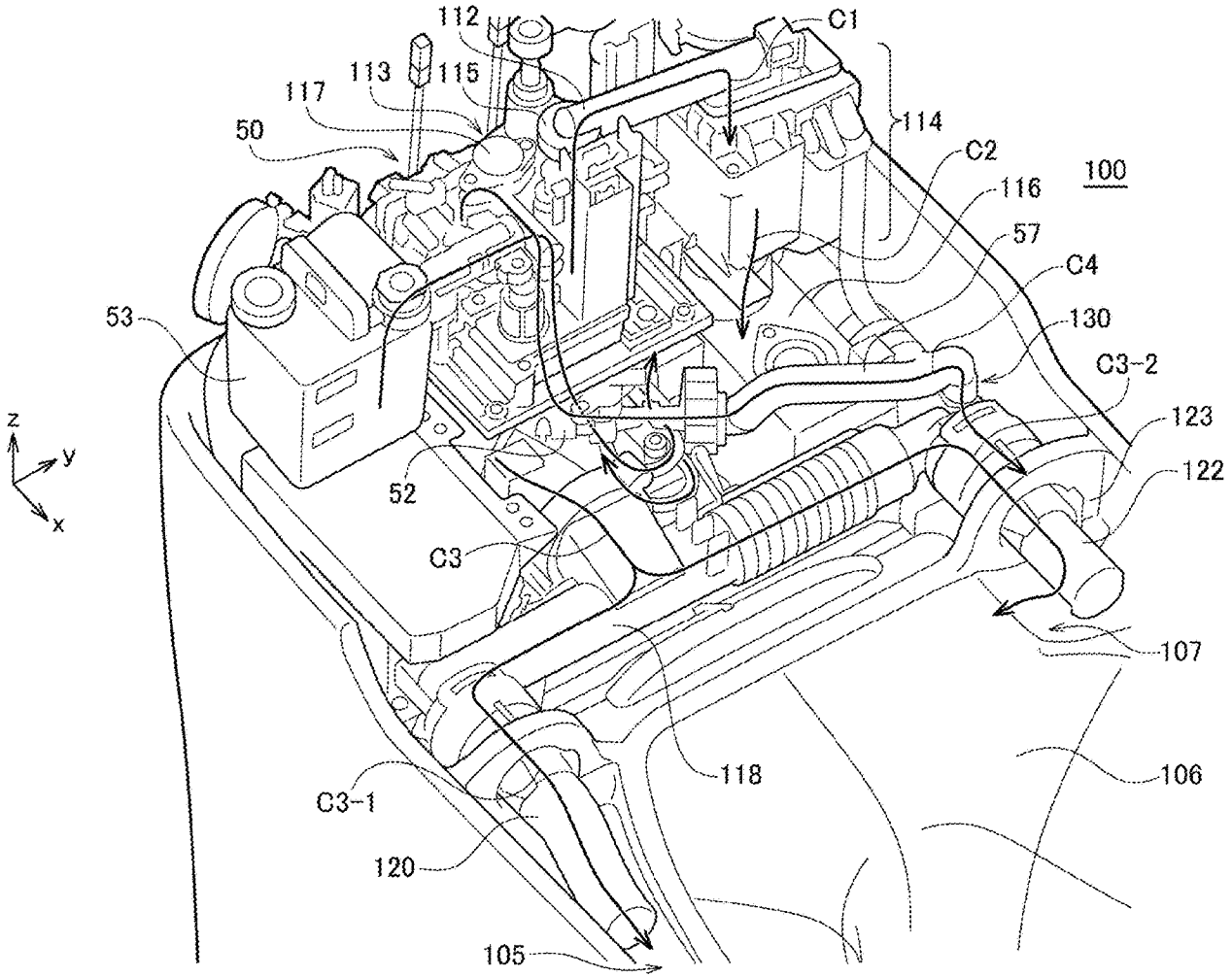
FIG. 2 is an enlarged perspective view of the inside of a rear end of the flush toilet according to the embodiment of the present invention.
Figure 3:
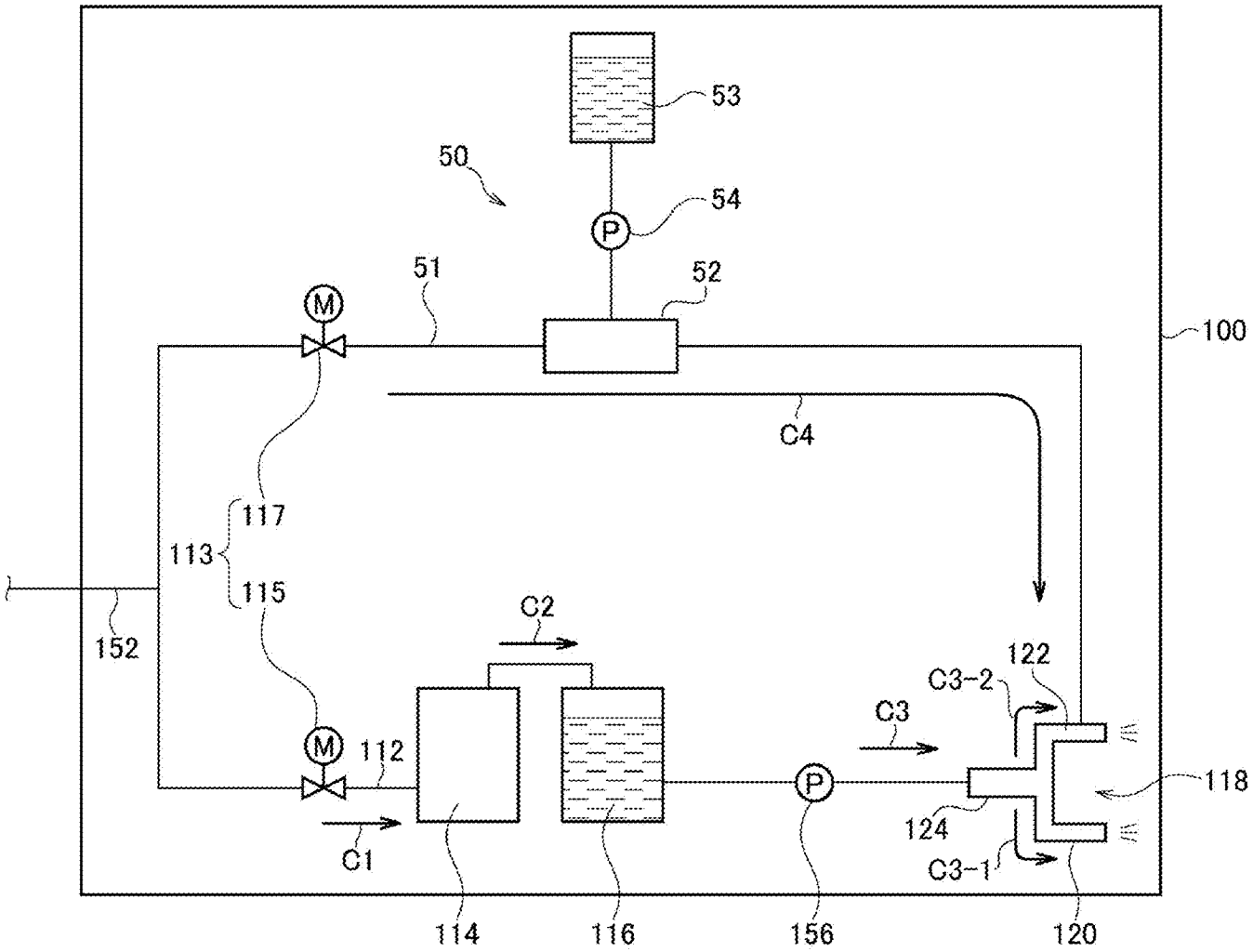
FIG. 3 is a configuration diagram of the flush toilet according to the embodiment of the present invention.
Figure 4:
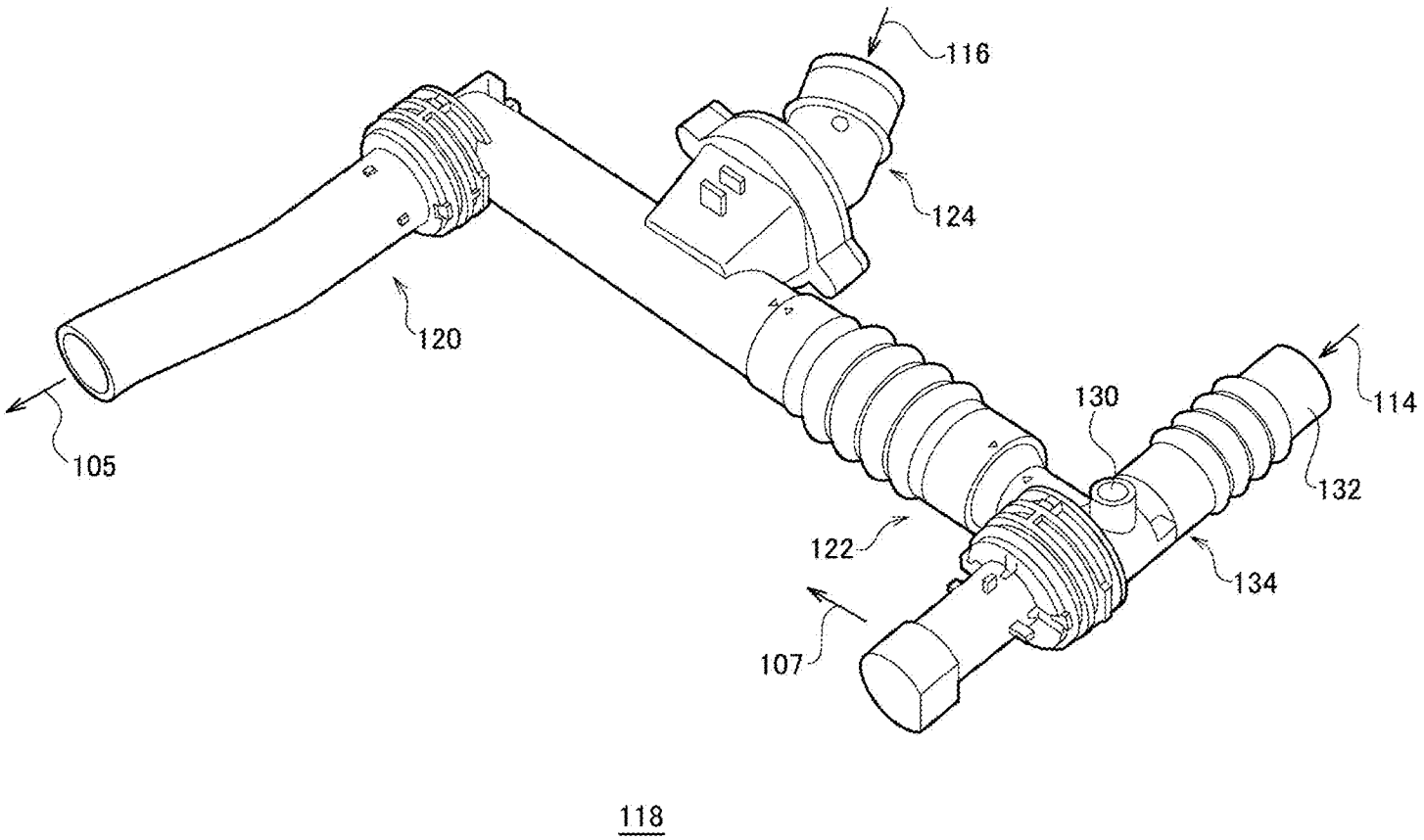
FIG. 4 is an external perspective view of a water discharge pipe.

FIG. 2 is an enlarged perspective view of the inside of a rear end of the flush toilet 100. FIG. 3 is a configuration diagram of the flush toilet 100. FIG. 4 is an external perspective view of the water discharge pipe.

As illustrated in FIGS. 2 and 3, the flush toilet 100 includes a valve unit 113. The valve unit 113 is connected to a water supply pipe 152 (see FIG. 3) connected to waterworks. The valve unit 113 includes a flush water valve 115 and a bubble valve 117 (the valve unit 113 will be described later). When the flush water valve is opened, flush water enters a water receiver 114 via a replenishment pipe 112 (route C1). The flush water of the water receiver 114 flows into a flush water tank 116 therebelow as it is and is stored in the flush water tank 116 (route C2).

When a user operates a flush button (not illustrated), a flush water pump 156 (see FIG. 3) in a lower part of the flush toilet 100 operates, and the flush water in the flush water tank 116 is sent to a water discharge pipe 118 (route C3). The water discharge pipe 118 branches from a main pipe 124 to two pipes of a first water discharge pipe 120 and a second water discharge pipe 122. The flush water having flowed from the main pipe 124 to the first water discharge pipe 120 is discharged from the first water discharge port 102 via a first flush water conduit 105 (route C3-1). Meanwhile, the flush water having flowed from the main pipe 124 to the second water discharge pipe 122 is discharged from the second water discharge port 104 via a second flush water conduit 107 (route C3-2). The flush water valve 115, the water receiver 114, the flush water tank 116, and the flush water pump 156 form a flush water supply mechanism that supplies flush water to the toilet bowl part 106.

The water receiver 114 communicates not only with the flush water tank 116 but also with an overflow pipe 132 (see FIG. 4) communicating with an overflow passage (not illustrated). The flush water in the water receiver 114 is supplied to the flush water tank 116. However, when the amount of stored water in the flush water tank 116 is excessively increased due to a failure of the valve unit 113 or other reasons, flush water overflows from the water receiver 114. Therefore, an overflow of water is prevented by allowing the water receiver 114 to discharge excessive flush water to the overflow pipe 132. The overflow pipe 132 discharges excessive water from a discharge port 134, and the discharge port 134 in this embodiment is coupled to the second water discharge pipe 122 (see FIG. 4). Therefore, the excessive water in the water receiver 114 is discharged into the toilet bowl part 106 via the second flush water conduit 107 and the second water discharge port 104.

The routes C1, C2, C3, C3-1, and C3-2 described above form a flush water conduit for guiding flush water toward the toilet bowl part 106. That is, up to the first water discharge port 102 or the second water discharge port 104 (before the toilet bowl part 106) is included in the flush water conduit. In the flush toilet 100 according to the present embodiment, a bubble passage (route C4) for guiding bubbles toward the toilet bowl part 106 is provided separately from the flush water conduit. In this bubble passage, a bubble generator 50 for generating bubbles is provided. Hereinafter, the bubble generator 50 will be described in detail.

Figure 5:
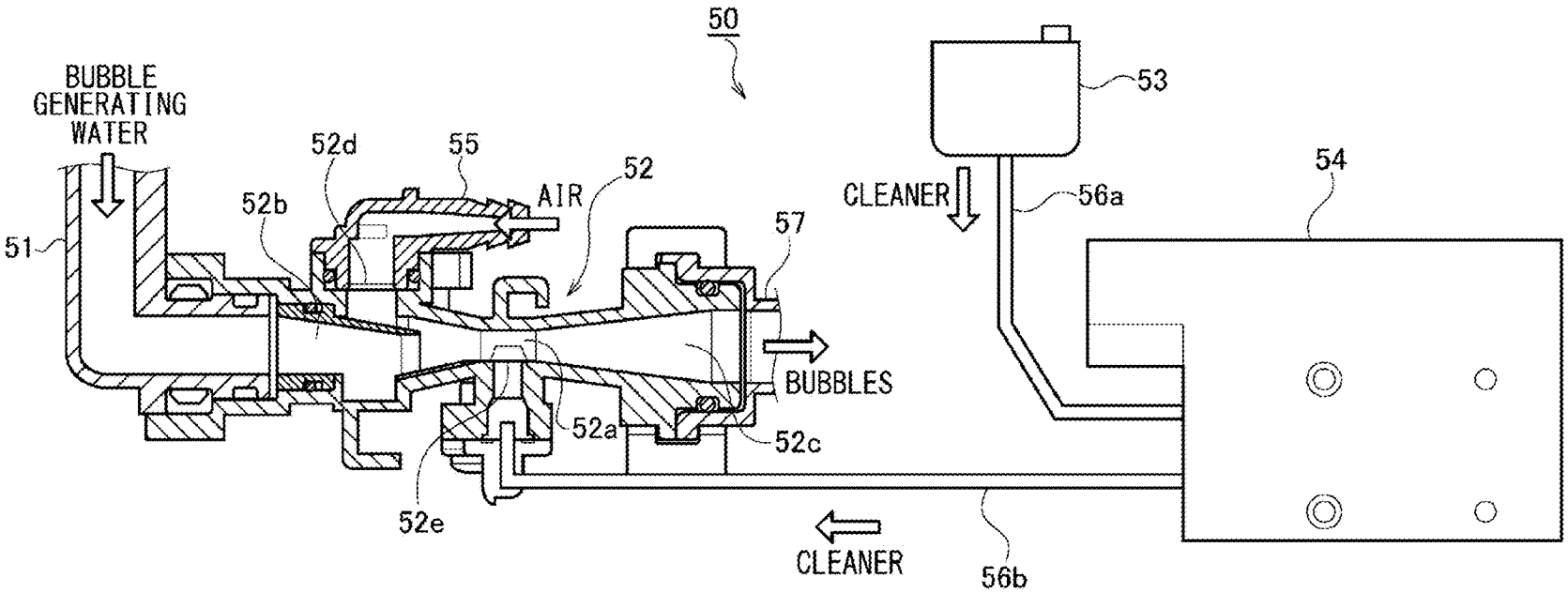
FIG. 5 is a diagram for explaining a configuration of a bubble generator.

FIG. 5 is a diagram for explaining a configuration of the bubble generator 50. As illustrated in FIG. 5, the bubble generator 50 includes a bubble passage water supply pipe 51, an ejector 52, a cleaner tank 53, and a cleaner pump 54. A bubble valve (bubble valve 117 in FIGS. 2 and 3) is provided on an upstream side of the bubble passage water supply pipe 51, and when the bubble valve is in an open state, water (hereinafter referred to as "bubble generating water" as appropriate) is supplied into the bubble passage water supply pipe 51. The ejector 52 is connected in a downstream side of the bubble passage water supply pipe 51. In the ejector 52, the diameter of an intermediate part of the flow passage is narrower than the diameter of the upstream or the downstream flow passage. The part with a narrower diameter of flow passage is called a "small diameter part 52*a*", the upstream side from the small diameter part 52*a* is called an "upstream part 52*b*", and the downstream side from the small diameter part 52*a* is called a "downstream part 52*c*". In the upstream part 52*b* of the ejector 52, an air supply port 52*d* for introducing the air into the ejector 52 is provided, and an air supply pipe 55 is connected to the air supply port 52*d*. Moreover, in the small diameter part 52*a* of the ejector 52, a cleaner supplier 52*e* for introducing the cleaner into the ejector 52 is provided. Furthermore, a bubble pipe 57 for discharging the bubbles generated in the ejector 52 toward the toilet bowl part 106 is connected to the downstream side of the ejector 52. The cleaner tank 53 stores the cleaner. The cleaner pump 54 is connected to the cleaner tank 53 via the first hose 56*a* and is connected to the cleaner supplier 52*e* of the ejector 52 via the second hose 56*b*. This cleaner supplier 52*e* is provided on a lower surface of the small diameter part 52*a* of the ejector 52.

In the bubble generator 50 configured as described above, when a user operates the flush button, the bubble valve is opened, whereby the bubble generating water is supplied into the bubble passage water supply pipe 51. This bubble generating water flows into the ejector 52. The cleaner pump 54 is operated at the same timing as when the bubble valve is opened, and the cleaner stored in the cleaner tank 53 is supplied into the ejector 52 from the cleaner supplier 52*e*. When the ejector 52 receives the flows, an ejector effect is generated in which the interior of the ejector is negatively pressured. By this ejector effect, the air is drawn into the ejector 52 from the air supply port 52*d*, and the flush water, the air, and the cleaner are mixed in the ejector 52 to generate bubbles. The bubbles generated in the ejector 52 flow into the bubble pipe 57.

Figure 6:
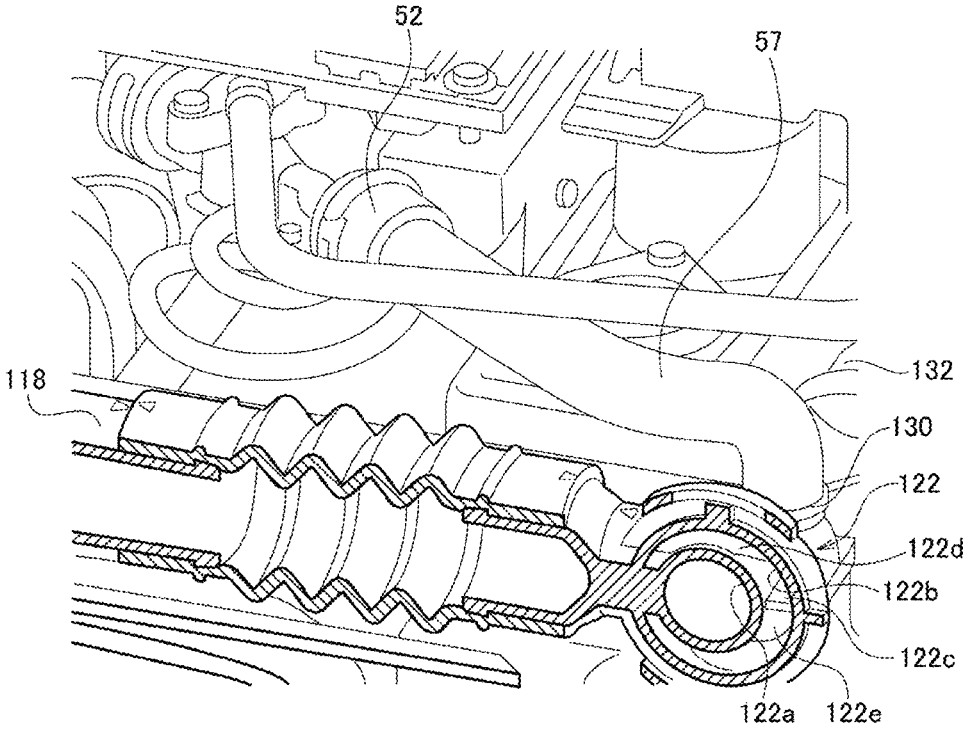
FIG. 6 is an enlarged view of the periphery of a connection part of a flush water conduit and a bubble passage.

FIG. 6 is an enlarged view of the periphery of a connection part of the flush water conduit and the bubble passage. In FIG. 6, a part of the water discharge pipe 118 and the second water discharge pipe 122 is cut out. As illustrated in FIG. 6, a bubble discharge port 130 of the bubble passage (bubble pipe 57) is connected to the flush water conduit (second water discharge pipe 122). As illustrated in FIG. 6, in the second water discharge pipe 122, an inner pipe 122*a* and an outer pipe 122*b* are layered, and a space between the inner pipe 122*a* and the outer pipe 122*b* is horizontally divided by a partition 122*c* into two (Hereinafter referred to as an "upper space 122*d*" and a "lower space 122*e*"). The flush water having flowed through the flush water conduit (water discharge pipe 118) flows through the inner pipe 122*a* and is discharged to the toilet bowl part 106 via the second flush water conduit 107 and the second water discharge port 104. The bubbles having flowed through the bubble passage (bubble pipe 57) and discharged from the bubble discharge port 130 flows through the upper space 122*d* and is discharged to the toilet bowl part 106 via the second flush water conduit 107 and the second water discharge port 104. As a result, a bubble layer is formed on a water surface of the toilet bowl part 106. The excessive water having flowed through the overflow pipe flows through the lower space 122*e* and is discharged to the toilet bowl part 106 via the second flush water conduit 107 and the second water discharge port 104. In this manner, the flush water, the bubbles, and the excessive water are discharged to the second flush water conduit 107 via paths different from one another, and are discharged to the toilet bowl part 106 via the second flush water conduit 107 and the second water discharge port 104.

In the flush toilet 100 according to the present embodiment, since the bubble passage is connected to the flush water conduit, no part for connecting the bubble passage to the toilet bowl part 106 is required, and the number of parts can be reduced.

In the embodiment described above, there is only one way of discharging bubbles from the second water discharge port 104, however in another embodiment, two ways of discharging bubbles can be implemented. In the flush toilet 100 according to another embodiment of the present invention, a switching valve (not illustrated) that switches between a first state in which bubbles are discharged toward the toilet bowl part 106 and a second state in which bubbles are discharged into the flush water conduit (water discharge pipe 118) is provided at a connection part of the bubble discharge port 130 of the bubble passage and the flush water conduit (second water discharge pipe 122). By including such a switching valve, two ways of discharging bubbles can be implemented.

Figure 7:
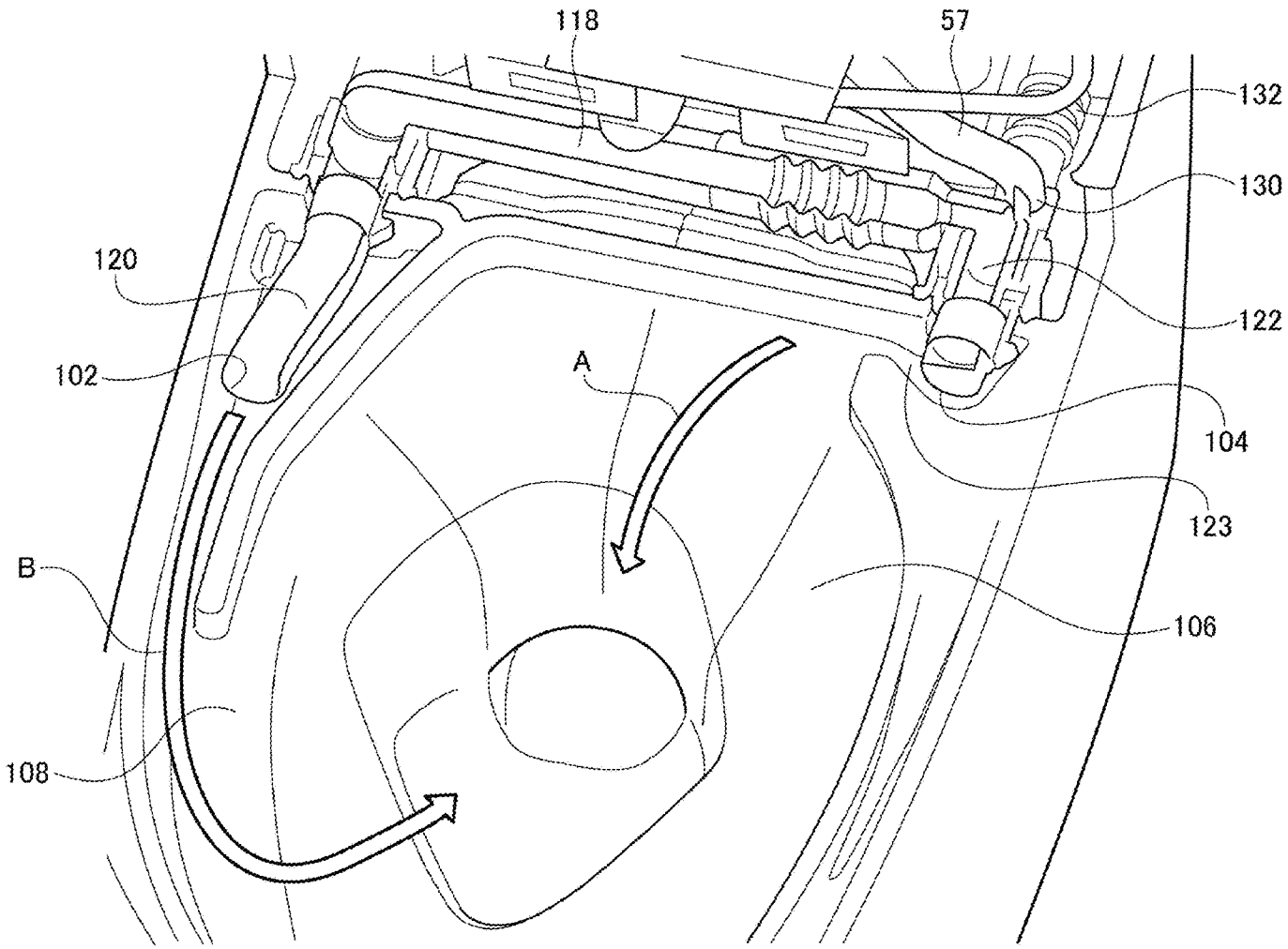
FIG. 7 is a diagram for explaining two ways of discharging bubbles in the flush toilet according to an embodiment of the present invention.

FIG. 7 is a diagram for explaining two ways of discharging bubbles in the flush toilet 100 according to another embodiment of the present invention. When the switching valve described above is switched to the first state, bubbles are supplied from the upper space 122*d* (see FIG. 6) of the second water discharge pipe 122 into the toilet bowl part 106 via the second flush water conduit 107 and the second water discharge port 104. At this time, the bubbles directly fall along the inner wall surface of the toilet bowl part 106, whereby a bubble layer is formed on a water surface of the toilet bowl part 106 (bubble passage A in FIG. 7). In the second flush water conduit 107, a bubble accumulating space 123 is formed. Bubbles accumulated in the bubble accumulating space 123 are supplied into the toilet bowl part 106 as described above.

On the other hand, when the switching valve is switched to the second state, bubbles are discharged toward the flush water conduit (water discharge pipe 118) and accumulated in the water discharge pipe 118. The bubbles accumulated in the water discharge pipe 118 together with the flush water supplied by the flush water supply mechanism pass through the first water discharge pipe 120 and the second water discharge pipe 122 as bubble-mixed flush water, are discharged to the first water discharge port 102 and the second water discharge port 104, and swirls and falls inside the toilet bowl part 106, whereby a bubble layer is formed on a water surface in the toilet bowl part 106 (bubble passage B in FIG. 7).

As described above, according to the flush toilet 100 according to the other embodiment of the present invention, it is possible to implement two different ways of discharging bubbles by switching the switching valve depending on an intended use When the switching valve is in the first state and bubbles are discharged along the bubble passage A, bubbles can be intensively discharged to a part of the toilet bowl part 106 where relatively more dirt tends to stay. On the other hand, when the switching valve is in the second state and bubbles are discharged along the bubble passage B, since bubbles are discharged along with the flow of flush water, bubbles can spread on the water surface in a short time.

Figure 8:
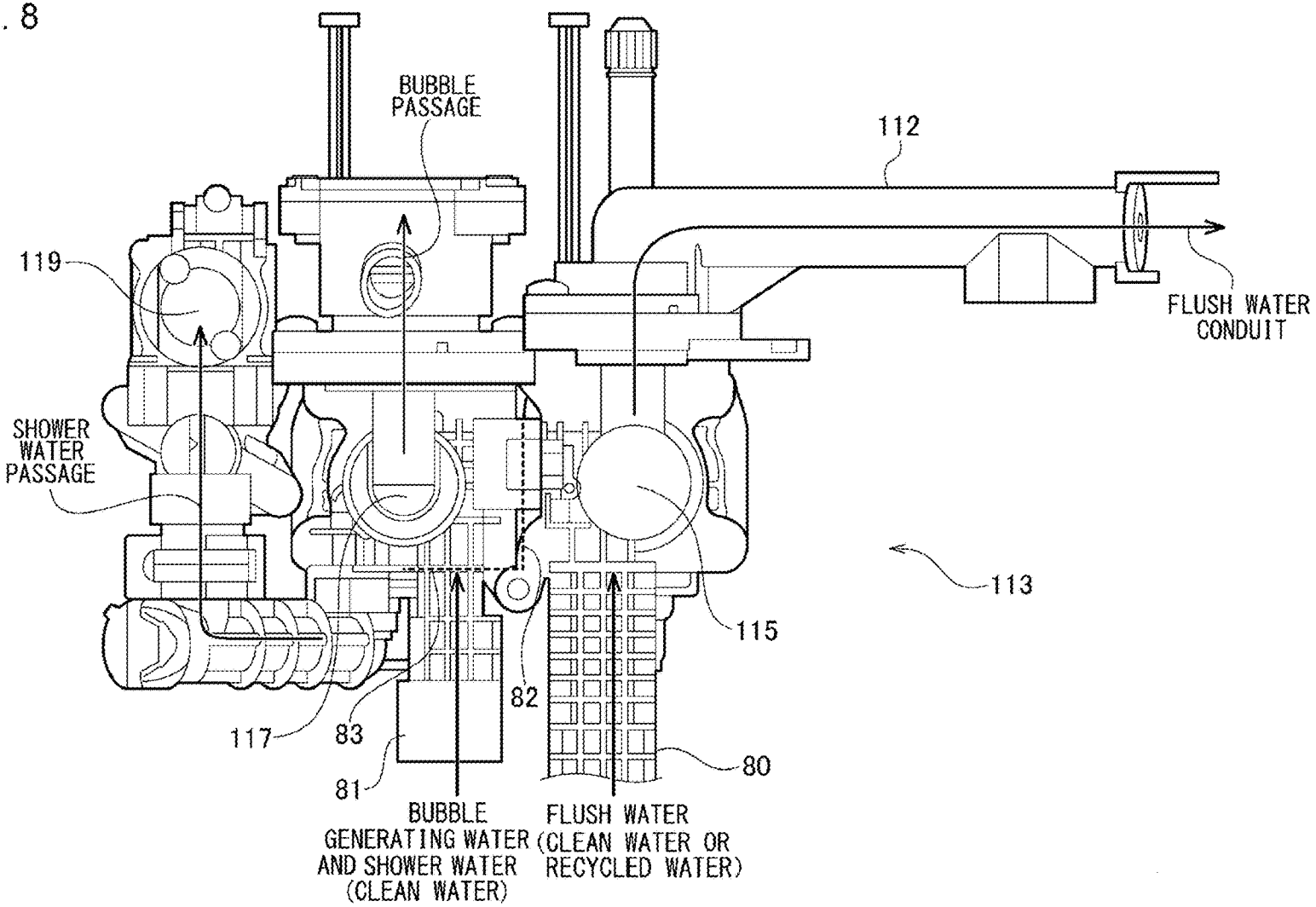
FIG. 8 is a diagram for explaining a valve unit.

FIG. 8 is a diagram for explaining the valve unit 113. As illustrated in FIG. 8, the valve unit 113 includes the flush water valve 115, the bubble valve 117, and a shower valve 119.

The valve unit 113 illustrated in FIG. 8 allows not only clean water but also recycled water to be used as flush water by merely making slight changes. First, an embodiment in which clean water is used as flush water will be described. Note that, as bubble generating water, only clean water having stable water quality is used in order to generate desired bubbles. In addition, since shower water used for a shower toilet is for washing a private part, only clean water having stable water quality is used.

In the valve unit 113 according to an embodiment using clean water as flush water, a water supply route to the flush water conduit and a water supply route to the bubble passage are not separated. As illustrated in FIG. 8, the valve unit 113 includes a first water supplier 80 and a second water supplier 81. In the valve unit 113, a partition wall 83 is provided between the second water supplier 81 and the bubble valve 117. Meanwhile, a partition wall 82 between the flush water valve 115 and the bubble valve 117 is not provided. In the valve unit 113 structured in this manner, clean water supplied from the first water supplier 80 is supplied to all the valves in the valve unit 113 and discharged to the flush water conduit, the bubble passage, and a shower water passage. When flush water is to be discharged, the flush water valve 115 is opened. When bubbles are to be generated, the bubble valve 117 is opened, and when shower water is to be discharged, the shower valve 119 is opened.

On the other hand, in the valve unit 113 according to an embodiment using recycled water as flush water, a water supply route to the flush water conduit and a water supply route to the bubble passage are separated. The partition wall 82 is provided between the flush water valve 115 and the bubble valve 117 such that water supplied from the first water supplier 80 and the second water supplier 81 does not mix in the valve unit 113. Meanwhile, the partition wall 83 between the second water supplier 81 and the bubble valve 117 is not provided. As a result, it is possible to supply recycled water to the first water supplier 80 and to use the recycled water as flush water as well as to supply clean water to the second water supplier 81 to use the clean water as bubble generating water. Note that the water supplied from the second water supplier 81 is discharged also to the shower water passage via the shower valve 119.

The partition walls as described above can be easily modified only by changing an insert die for integrally forming the flush water valve 115 and the bubble valve 117.

In the flush toilet 100 described above, the bubble passage is provided separately from the flush water conduit, and the bubble generator is provided in the bubble passage. Therefore, it is possible to maintain an adequate amount of flush water without needing to reduce the diameter of a part of the flush water conduit as in the conventional art. In addition, since the bubble passage and the bubble generator can be optimally designed to generate bubbles, bubbles can be suitably supplied into the toilet bowl part 106.

In the flush toilet 100 described above, the bubble generator 50 and the bubble passage are assembled to the toilet main body including the toilet bowl part 106. However, the bubble generator and the bubble passage may be structured as a bubble generation unit separate from the main body of the toilet bowl such that the bubble generation unit can be mounted to the main body of the toilet bowl. Also in this case, as a matter of course, since the bubble passage is provided separately from the flush water conduit, a similar effect to that of the flush toilet 100 described above can be obtained. The bubble generation unit may be assembled in a functional unit that provides, for example, a private part washing function, a hot air function, or other functions. In this case, it is possible to provide a bubble generating function to existing flush toilets.

The present invention has been described above on the basis of the embodiments. These embodiments are merely illustration. Therefore, it should be understood by a person skilled in the art that combinations of the components or processing processes may include various variations and that such a variation is also within the scope of the present invention.

Generalizing the invention embodied by the above embodiment leads to the following technical ideas.

In the aspect described in the means to solve the problem described above, the bubble discharge port of the bubble passage may be connected to the flush water conduit. In this case, since no part for connecting the bubble passage to the toilet bowl part is required, the number of parts can be reduced.

The switching valve that switches between the first state in which bubbles are discharged toward the toilet bowl part and the second state in which bubbles are discharged into the flush water conduit may be included at the connection part of the bubble discharge port of the bubble passage and the flush water conduit. In this case, it is possible to implement two different ways of discharging bubbles by switching the switching valve depending on an intended use.

The water supply route to the flush water conduit and the water supply route to the bubble passage may be separated. In this case, it is possible to use recycled water as flush water and to use clean water as water for bubble generation.

The invention claimed is:

1. A flush toilet, comprising:

a toilet bowl part;

a flush water conduit in a pipe shape that guides flush water toward the toilet bowl part when the toilet bowl part is washed;

a bubble passage provided separately from the flush water conduit, the bubble passage guiding bubbles toward the toilet bowl part; and a bubble generator provided in the bubble passage, the bubble generator that generates bubbles, wherein a bubble discharge port of the bubble passage is connected to the flush water conduit.

2. The flush toilet of claim 1, wherein the bubble discharge port of the bubble passage is connected to the flush water conduit in a downstream side of the bubble generator.

3. A flush toilet comprising:

a toilet bowl part;

a flush water conduit that guides flush water toward the toilet bowl part;

a bubble passage provided separately from the flush water conduit, the bubble passage guiding bubbles toward the toilet bowl part; and a bubble generator provided in the bubble passage, the bubble generator that generates bubbles, wherein a bubble discharge port of the bubble passage is connected to the flush water conduit, the flush toilet further comprising:

a switching valve included at a connection part of the bubble discharge port of the bubble passage and the flush water conduit, the switching valve that switches between a first state in which bubbles are discharged toward the toilet bowl part and a second state in which bubbles are discharged into the flush water conduit.

4. The flush toilet of claim 1, wherein a water supply route to the flush water conduit and a water supply route to the bubble passage are separated.

* * * * *